US007416579B2

(12) United States Patent
Halalay et al.

(10) Patent No.: US 7,416,579 B2
(45) Date of Patent: Aug. 26, 2008

(54) PREPARING NANOSIZE PLATINUM-TITANIUM ALLOYS

(75) Inventors: Ion C. Halalay, Grosse Pointe, MI (US); Michael Kevin Carpenter, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 260 days.

(21) Appl. No.: 11/177,840

(22) Filed: Jul. 8, 2005

(65) Prior Publication Data

US 2007/0131056 A1 Jun. 14, 2007

(51) Int. Cl.

| | |
|---|---|
| ***B22F 9/24*** | (2006.01) |
| ***B22F 9/26*** | (2006.01) |
| ***B22F 9/02*** | (2006.01) |
| ***B01J 37/34*** | (2006.01) |
| *B01D 47/02* | (2006.01) |
| *B01J 13/00* | (2006.01) |

(52) U.S. Cl. ..... 75/345; 75/335; 75/351; 204/157.15; 204/157.42; 261/24; 261/126; 261/151; 429/40; 502/101; 502/104; 977/775

(58) Field of Classification Search ..... 75/335, 75/345, 351; 204/157.15, 157.42; 429/40; 502/101, 104; 977/775

See application file for complete search history.

(56) References Cited

U.S. PATENT DOCUMENTS

| | | | | |
|---|---|---|---|---|
| 6,589,501 | B2 * | 7/2003 | Moser et al. | 423/659 |
| 7,189,279 | B2 * | 3/2007 | Guillet | 75/343 |
| 7,318,977 | B2 * | 1/2008 | He et al. | 429/44 |
| 2006/0257719 | A1 * | 11/2006 | Merzougui et al. | 429/44 |
| 2007/0113704 | A1 * | 5/2007 | Carpenter et al. | 75/345 |
| 2007/0259251 | A1 * | 11/2007 | He et al. | 429/40 |
| 2008/0042305 | A1 * | 2/2008 | Halalay | 261/151 |

OTHER PUBLICATIONS

T. Fujimoto et al. Sonochemical Preparation of Single-Dispersion Metal Nanoparticles from Metal Salts. Chem. Mater. 2001, 13, 1057-1060; Mar. 2, 2001.*

T.R. Ralph and M.P. Hogarth. Catalysis for Low Temperature Fuel Cells: Part I: The Cathode Challenges. Platinum Metals Rev., 2002, 46(1), 3-14; Jan. 1, 2002.*

R.A. Salkar et al. The Sonochemical preparation of amorphous silver nanoparticles. J. Mater. Chem., 1999, 9, 1333-1335.*

T.J. Mason, J.P. Lorimer. Applied Sonochemistry: Uses of Power Ultrasound in Chemistry and Processing. Copyright 2002, Wiley-VCH Verlag, GmbH & Co. KgaA, ISBN 3-527-302050. pp. 78, 86.*

Y. Mastai and A. Gedanken. Sonochemistry and Other Novel Methods Developed for the Synthesis of Nanoparticles Y. Mastai and A. Gedanken. In: C.N.R. Rao, A. Mueller and A.K. Cheetham, Editors, The Chemistry of Nanomaterials, Wiley-VCH, NY (Published online Jan. 28, 2005)) pp. 113-115.*

W. Huang, et al. Selective synthesis of anatase and rutile via ultrasound irradiation. Chem. Commun., 2000, 1415-1416. Jul. 11, 2000.*

P. Diodati, et al. Sonochemical production of a non-crystalline phase of palladium. Ultrason. Sonochem. 4 (1997) 45-48.*

S.A. Cotton. Chemistry of Precious Metals. Springer-Verlag : Chapter 3, "Palladium and Platinum", pp. 173,199.*

K.S. Suslick. The Chemical Effects of Ultrasound. Scientific American, Feb. 1080, pp. 80-86.*

L. H. Thompson and L. K. Doraiswamy. Sonochemistry: Science and Engineering. Ind. Eng. Chem. Res. 1999, 38, p. 1215-1249.*

Q. Li et al. Sonochemical synthesis, structural and magnetic properties of air-stable Fe/Co alloy nanoparticles, New J. Chem, 2003, vol. 27, p. 1194-1199.*

R. Oshima et al. Electron microscopy of noble metal alloy nanoparticles prepared by sonochemical methods, Nanostructured Materials, 1999, vol. 12, p. 111-114.*

Kenneth S. Suslick, The Chemical Effects of Ultrasound, Scientific American, Feb. 1989, pp. 80-86.

Kenneth S. Suslick and Gareth J. Price, Applications of Ultrasound to Materials Chemistry, Annu. Rev. Mater. Sci. 1999, pp. 295-326.

* cited by examiner

*Primary Examiner*—Roy King
*Assistant Examiner*—Mark L Shevin

(57) ABSTRACT

Nanometer sized particles containing titanium and platinum are prepared by a sonochemical process. Compounds of the metals are dissolved, suspended, or diluted in a low vapor pressure liquid medium, preferably at a sub-ambient temperature. A reducing gas is bubbled through the liquid as it is subjected to cavitation to affect the reductive decomposition of the metal compounds. Titanium and platinum are co-precipitated in very small particles.

9 Claims, No Drawings

PREPARING NANOSIZE PLATINUM-TITANIUM ALLOYS

TECHNICAL FIELD

This invention pertains to the preparation of nanometer size particles of platinum-titanium alloys. More specifically, this invention pertains to the application of ultrasound energy to a dispersion or solution of platinum and titanium precursor compound(s) to produce small particles of platinum-titanium alloys. The particles may be used, for example, as a catalyst.

BACKGROUND OF THE INVENTION

A challenge to the development of economically viable polymer electrolyte membrane (PEM)-containing fuel cells for automotive applications, is the high cost of platinum currently required in the cathode for the catalytic reduction of oxygen. Various platinum alloy catalysts have exhibited improved mass activities for oxygen reduction and platinum-titanium alloy catalysts have shown some of the more promising activities. In addition, the titanium component of the catalyst is expected to be reasonably stable under the acidic conditions encountered in a PEM fuel cell.

To be effective in a fuel cell, platinum alloy catalysts must be prepared as nanosize particles. Current methods of platinum-titanium catalyst synthesis require several wet chemical steps, culminating in a high-temperature reduction. This latter step is not ideal for obtaining nanoparticles since sintering of both metals occurs at the temperatures required to reduce titanium. A better method for the preparation of nanometer size platinum-titanium alloy particles is needed.

SUMMARY OF THE INVENTION

The invention uses high-frequency sound waves applied to a suitable inert liquid to induce the reduction (decomposition) of suspended or dissolved precursor compound(s) of platinum and titanium. The use of high-frequency sound to induce chemical reactions is sometimes called sonochemistry. In the practice of this invention, metallo-organic, organometallic, and/or halide compounds of platinum and titanium are suitable. A single precursor compound containing a suitable proportion of both platinum and titanium may be used, or separate compounds of platinum and titanium may be employed. Most of these materials are solids that can be suspended as particles or dissolved in low-vapor pressure liquids, but some titanium compounds are liquids. Generally inert, low vapor pressure hydrocarbon liquids such as decalin, tetralin, or tridecane are particularly suitable. The liquid is suitably maintained at a below-ambient temperature to further reduce its vapor pressure and to minimize loss of reactant during application of the high-frequency sound (ultrasound).

High-frequency sound waves, for example about 20 KHz, are generated in the liquid to produce cavitation. Small bubbles are continually produced which rapidly expand and collapse. The extreme temperature and pressure conditions created inside and in the immediate vicinity of the collapsing bubbles lead to the decomposition of the platinum and titanium precursor compounds, while the high cooling rates to the surrounding massive liquid yield very small particles with metastable (possibly amorphous) structure. The particles are of nanometer size and contain a mixture of platinum and titanium. In order to avoid oxidation of the small metal particles, a reducing gas such as hydrogen gas is bubbled through the liquid. In addition, the liquid may be separately covered (blanketed) with an inert gas such as argon. The initial proportion of platinum and titanium affects the proportion deposited in the resultant particles.

The sonic energy is applied for a time determined for decomposition of the metal precursor content of the liquid. After the sonic vibrations are stopped, the solid phases are separated from the liquid and any inorganic or organic compounds washed or dissolved from the metal particles. Depending on the conditions of the reduction reaction, the metal particles may be amorphous or partly crystalline. But they are typically less than about ten nanometers in diameter or largest particle dimension. Such particles often have useful catalytic properties.

This sonochemical method may be practiced as a batch process or a continuous process. A continuous process is particularly amenable to scale up for production of substantial quantities of the small particles of platinum or of platinum and titanium alloy or inter-metallic compound. The morphology of the particles may be varied by changing the compositions of the metal precursors and/or the liquid medium as well as the physical conditions of the sonochemical reaction. Furthermore, the method may allow the synthesis of nanoparticles that are smaller than the particles that can be obtained using conventional methods, due to the low temperatures (<0° C.) of the reaction medium during synthesis.

Other objects and advantages of the invention will become apparent from a detailed description of specific embodiments which follow.

DESCRIPTION OF PREFERRED EMBODIMENTS

This invention is a convenient, low-temperature method for preparing Pt—Ti nanometer size particle catalysts. The use of Pt—Ti catalysts will allow a reduced platinum loading on the cathode of the fuel cell, and thus reduce its cost. The two main sources for the degradation of the cathode performance in the fuel cell are carbon corrosion and sintering of the Pt catalyst particles. The presence of the titanium may prevent sintering of the catalyst particles and thus improve the durability of the cathode.

In accordance with this invention platinum-titanium alloys are synthesized under cavitation conditions to produce nanosize particles of the alloys by co-reduction of titanium and platinum molecular compounds. Titanium and platinum may be incorporated into the same sonically decomposable precursor compound, or separate compounds of the metals may be used. The process has been demonstrated with compounds of platinum (II) and titanium (IV). But it is considered feasible to use compounds of the metals in other oxidation states, such as platinum (IV) and titanium (III).

Examples of suitable separate compounds of titanium and platinum include titanium (IV) tetrachloride —$TiCl_4$, dicyclopentadienyl titanium dicarbonyl —$(C_5H_5)_2Ti(CO)_2$, indenyltitanium trichloride —$C_9H_7TiCl_3$, or titanium (IV) ethoxide —$Ti(OC_2H_5)_4$; and bis (ethylenediamine) platinum(II) dichloride —$[(NH_2CH_2CH_2NH_2)_2Pt]Cl_2$, dimethyl(1,5-cyclooctadiene) platinum (II)—$(CH_3)_2Pt(C_8H_{12})$, or platinum (II) acetylacetonate —$Pt(CH_3COCHCOCH_3)_2$. The reducing agent is hydrogen gas, either in pure form, or in a combination or mixture with an inert gas such as helium or argon.

A hydrocarbon solvent with low vapor pressure is suitable as the reaction medium and it may be cooled to sub-ambient temperatures. Tridecane, decalin, or tetralin are examples of suitable hydrocarbon liquids. Anaerobic conditions are maintained inside the reaction vessel by flowing high purity argon gas over the liquid surface, and the reducing gas (hydrogen) is bubbled through the liquid reaction medium during the reduction reaction. The average pressure inside the reaction vessel is close to atmospheric pressure throughout the reaction. The reaction vessel is cooled to sub-ambient temperatures in order to lower the vapor pressure of the reaction medium and volatile precursors, and in order to affect a selective entrainment of the reactants into the bubbles formed in it by cavitation.

Ultrasonic sound energy of suitable frequency and amplitude is used in the synthesis of the platinum and titanium containing particles. The frequency will usually be above about 16 KHz and depend upon the specific sound generating device that is used. A generator producing sonic energy at a frequency of about 20 KHZ is suitable.

The high-intensity ultrasound source or a high-shear mixer creates microscopic bubbles inside the reaction medium with diameters ranging from 10 to 200 μm with a lifetime of about one microsecond Temperatures and pressures in the bubbles can reach, respectively, 5000 K and 2 kbar. Each bubble is surrounded by a shell 2 to 10 μm in thickness, of extremely hot liquid in which the temperature can be as high as 2,000 K. Under these conditions in the liquid medium, the platinum and titanium molecular compounds are reduced to the respective metals, and nanosize alloy particles are formed due to the very fast cooling rates achieved in the process. The size and morphology of the particles can be varied by selectively adjusting, for example, the composition of the liquid medium, the composition or concentration of the precursors in the reaction medium, the temperature of the medium in the reaction vessel, or the duration and intensity (amplitude) of the ultrasonic pulses.

Experimental

A Pt—Ti alloy has been synthesized sonochemically from $TiCl_4$ and Pt $(CH_3COCHCOCH_3)_2$ precursors, under a flow of pure hydrogen gas in decalin. X-ray diffraction (XRD) and chemical analysis data indicate a disordered $Pt_3Ti$ alloy with crystallite size of about seven nanometers. Electrochemical tests showed that the oxygen reduction activity of the alloy was very close to that of pure platinum and that no platinum oxidation occurs for potentials as high as 1.2 V.

The reaction mixture, containing about equimolar amounts of titanium and platinum, was prepared in an inert atmosphere just prior to use. Fifty milliliters of the mixture were made by adding 0.5 ml of 1M $TiCl_4$ in toluene to 40 ml of decalin containing 0.1967 g of Pt (II) acetylacetonate dissolved in 0.5 ml of toluene. More decalin was added to take the volume up to 50 ml. The resulting yellow-orange mixture contained a significant amount of finely divided solid particles or colloidal material that did not readily settle.

30 ml of the mixture were placed in a sonication cell, a water-jacketed glass vessel with a port for the ultrasonic horn, and several other ports for gas management, solution addition, and temperature measurement. Hydrogen was bubbled through the mixture, and an argon blanket was maintained above the liquid.

Cooling was provided to the cell by a refrigerated circulating bath. The temperature of the reaction mixture was initially −8° C., but it quickly climbed to about 5° C. during the sonication. The mixture was exposed to 225 W of vibrational energy at 20 kHz (ultrasonic) with a duty cycle of 0.1 sec. "on" to 0.4 sec. "off". The sonication was allowed to continue with this protocol until 5.3 hrs of "on" time had accrued. The mixture was centrifuged and the solid was collected and washed with toluene.

Preferred process specifications for the synthesis of a specific alloy or intermetallic compound of titanium and platinum are suitably developed by varying conditions and compositions on a small scale batch reactor basis. The preferred batch reaction, with its specified precursor(s), liquid medium composition, liquid medium temperature, reducing gas composition and flow, and ultrasound frequency and intensity, can be scaled to a suitable production capacity. The process may also be conducted on a continuous basis by flowing a stream of the liquid medium and precursors around or past the ultrasonic generator.

While the invention has been described in terms of specific examples it is recognized that other modes of practice can readily be adapted by those skilled in the art. The scope of the invention is, to be limited only by the following claims.

The invention claimed is:

1. A method of making nanometer size metal particles comprising platinum and titanium, the method comprising:

suspending or dissolving a precursor compound or compounds of titanium and of platinum in a low vapor pressure hydrocarbon liquid medium;

bubbling a reducing gas through the liquid medium; and subjecting the liquid medium to ultrasonic vibrations at a temperature below ambient temperature to reduce the titanium and platinum constituents of the precursor or precursors to metal particles comprising platinum and titanium.

2. A method of making nanometer sized metal particles as recited in claim 1 in which particles of a solid compound of platinum are suspended in a liquid medium containing a liquid compound of titanium.

3. A method of making nanometer sized metal particles as recited in claim 1 in which the reducing gas is hydrogen.

4. A method of making nanometer sized metal particles as recited in claim 1 in which the reducing gas is a mixture of hydrogen gas and it is used in combination with at least one inert gas selected from the group consisting of argon, helium, and neon.

5. A method of making nanometer sized metal particles as recited in claim 1 in which the liquid medium comprises a hydrocarbon selected from the group consisting of tridecane, decalin, and tetralin.

6. A method of making nanometer sized metal particles as recited in claim 1 in which the titanium compound is a titanium halide or an organo-titanium compound.

7. A method of making nanometer sized metal particles as recited in claim 1 in which the titanium compound comprises at least one compound selected from the group consisting of titanium (IV) tetrachloride, dicyclopentadienyl titanium dicarbonyl, indenyltitanium trichloride, and titanium (IV) ethoxide.

8. A method of making nanometer sized metal particles as recited in claim 1 in which the platinum compound is a platinum halide or an organo-platinum compound.

9. A method of making nanometer sized metal particles as recited in claim 1 in which the platinum compound comprises at least one compound selected from the group consisting of bis (ethylenediamine) platinum (II) dichloride, dimethyl (1,5-cyclooctadiene) platinum (II), and platinum (II) acetylacetonate.

* * * * *